US006994037B2

(12) United States Patent
Hutmacher et al.

(10) Patent No.: US 6,994,037 B2
(45) Date of Patent: Feb. 7, 2006

(54) RABBLE ARM FOR A FURNACE

(75) Inventors: Patrick Hutmacher, Bettembourg (LU); Serge Streitz, Kayl (LU); Steve Arendt, Tétange (LU); Emile Lonardi, Bascharage (LU); Edgar Kraemer, Hellange (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 10/475,435

(22) PCT Filed: Apr. 19, 2002

(86) PCT No.: PCT/EP02/05114

§ 371 (c)(1),
(2), (4) Date: Feb. 26, 2004

(87) PCT Pub. No.: WO02/086407

PCT Pub. Date: Oct. 31, 2002

(65) Prior Publication Data

US 2004/0134394 A1 Jul. 15, 2004

(30) Foreign Application Priority Data

Apr. 20, 2001 (LU) ..... 90762

(51) Int. Cl.
*F23G 5/00* (2006.01)

(52) U.S. Cl. ..... 110/247; 432/235; 432/131

(58) Field of Classification Search ..... 432/235, 432/233, 124, 131, 138, 139, 142; 425/DIG. 101; 110/223, 225, 247, 342
See application file for complete search history.

(56) References Cited

U.S. PATENT DOCUMENTS

| | | | | | |
|---|---|---|---|---|---|
| 1,404,902 | A | * | 1/1922 | Skinner | 432/235 |
| 1,468,216 | A | | 9/1923 | Skinner | |
| 1,484,791 | A | * | 2/1924 | Leggo | 432/131 |
| 1,529,256 | A | | 3/1925 | Kelley | |
| 1,687,935 | A | | 10/1928 | Fowler | |
| 1,736,769 | A | | 11/1929 | Connolly | |
| 1,879,680 | A | * | 9/1932 | Baird et al. | 432/131 |
| 2,654,137 | A | * | 10/1953 | Buron | 501/80 |
| 3,419,254 | A | * | 12/1968 | Von Dreusche, Jr. | 432/131 |
| 3,740,184 | A | * | 6/1973 | Oleszko | 432/235 |
| 3,788,800 | A | * | 1/1974 | Middleton et al. | 432/235 |
| 4,842,051 | A | | 6/1989 | Brownlee | |

FOREIGN PATENT DOCUMENTS

| | | |
|---|---|---|
| DE | 321523 | 6/1920 |
| DE | 389355 | 1/1924 |

* cited by examiner

*Primary Examiner*—Kenneth Rinehart
(74) *Attorney, Agent, or Firm*—McCormick, Paulding & Huber LLP

(57) ABSTRACT

A rabble arm for a furnace includes an elongated metallic support core, at least one rabble tooth having a rabble portion and a fixing portion and a fixing device co-operating with the fixing portion for fixing the rabble tooth to the elongated metallic support core. The fixing portion includes a through hole through which the elongated metallic support core axially passes. The fixing device co-operates with the fixing portion around the through hole for fixing the rabble tooth to the elongated metallic support core.

24 Claims, 3 Drawing Sheets

Fig. 5
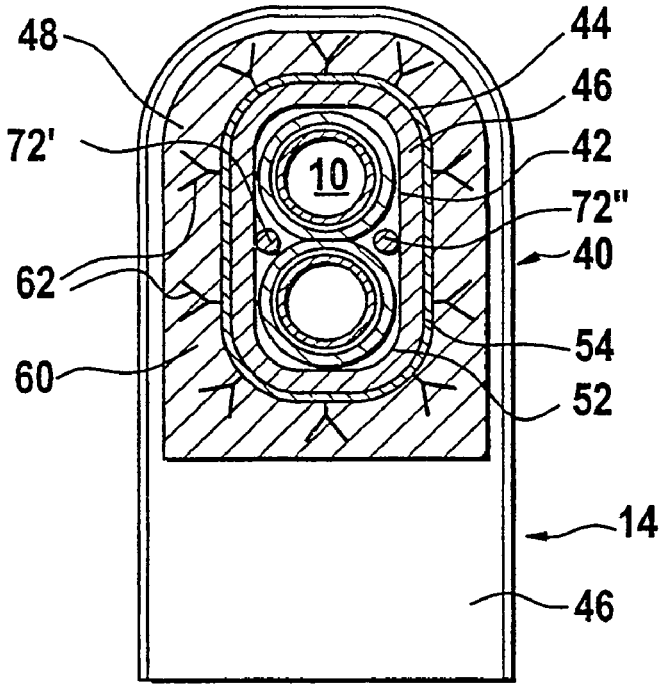
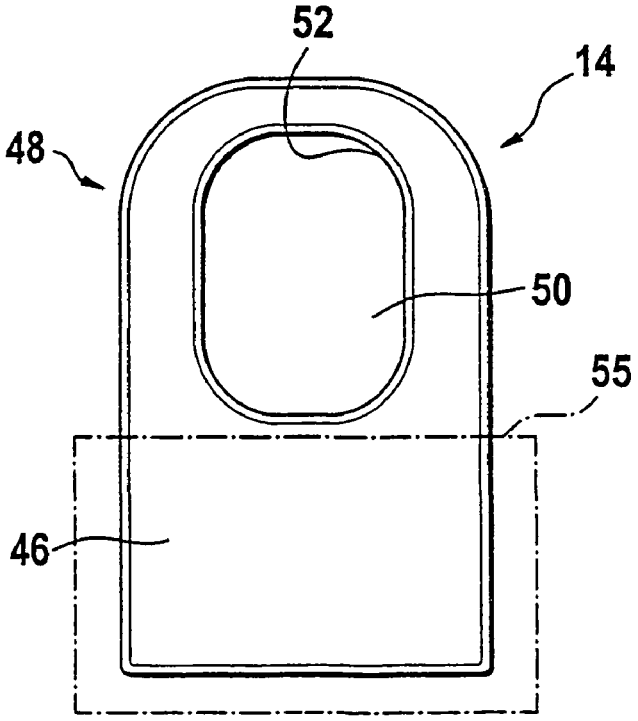
Fig. 6
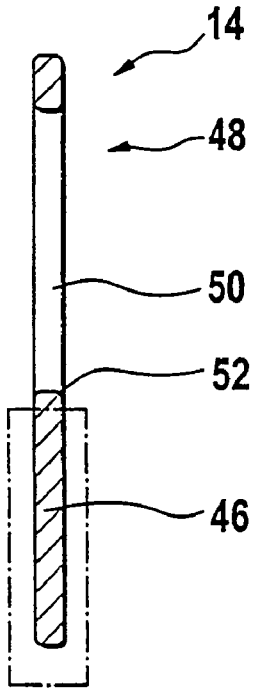
Fig. 7

RABBLE ARM FOR A FURNACE

CROSS-REFERENCE TO RELATED APPLICATIONS

This application is entitled to the benefit of International Application No. PCT/EP02/05114 filed on Apr. 19, 2002, and Luxembourg Patent Application No. 90 762 filed on Apr. 20, 2001.

FIELD OF THE INVENTION

The present invention relates to a rabble arm for a furnace, in particular a multiple hearth furnace.

BACKGROUND OF THE INVENTION

A multiple hearth furnace comprises an upright cylindrical furnace housing that is divided by a plurality of vertically spaced hearth floors in vertically aligned hearth chambers. A vertical shaft extends centrally through the hearth chambers, passing through each hearth floor. In each hearth chamber at least one rabble arm is fixed to the vertical shaft and extends radially outside there-from over the hearth floor. Such a rabble arm is provided with rabble teeth, which extend down into material being processed on the hearth floor. As the vertical shaft rotates, the rabble arm moves over the material on the respective hearth floor, wherein the rabble teeth plough through the material and mix the latter. Depending on the angle of inclination of the rabble teeth, the material will be moved radially inwardly toward the vertical shaft or outwardly therefrom. Drop holes are provided in each hearth floor, alternately in the inner zone of the hearth floor (i.e. near the vertical shaft) or in the outer zone of the hearth floor (i.e. near the cylindrical furnace housing). Material falling on the inner zone of a hearth floor is moved by the rabble arm radially outwardly over this hearth floor, until it drops through a drop hole in the outer zone of this hearth floor on the outer zone of a hearth floor located directly below. On this lower hearth floor, material is moved by the rabble arm radially inwardly until it drops through a drop hole in the inner zone of this hearth floor on the inner zone of the next lower hearth floor. Thus, material to be processed is caused to move slowly along a serpentine path through the vertically aligned hearth chambers of the furnace.

It is a fact that multiple hearth furnaces possess major advantages over other solid material processing furnaces, such as rotary hearth furnaces, rotary kiln furnaces and shaft furnaces. By allowing a control of different hearth atmospheres and temperatures in the vertically aligned hearth chambers, they allow a very close control of the process inside the furnace. Other advantages of multiple hearth furnaces lie in their ability to maintain the processed materials in mixed condition throughout their passage through the furnace and to warrant a very intense exposure of the solid materials to process gases in a controlled gas/solid material counter flow within the furnace. Nevertheless, since their invention at the end of the nineteenth century, multiple hearth furnaces have only found very few applications in solid material processing. A reason for this lack of confidence in multiple hearth furnaces is that it has never been possible to warrant a problem-free operation of a multiple hearth furnace over longer periods.

The most exposed elements in a multiple hearth furnace are the rabble arms with their rabble teeth. These rabble arms and rabble teeth are subjected to severe temperatures and severe mechanical constraints in a furnace atmosphere that is usually very corrosive. Already in very early multiple hearth furnaces, the rabble arms included a water or gas cooled cast iron support structure, and the rabble teeth were conceived as exchangeable wear parts. Such an exchangeable rabble tooth generally includes a dovetail interlocking element at its upper portion engaging, in a form-fit relationship, a corresponding groove at the underside of the cooled metallic support structure.

An allegedly improved design of a rabble arm was disclosed in 1968 in U.S. Pat. No. 3,419,254. This rabble arm includes a hollow cast iron core obtained by mould casting. It is divided by a central web into two separate passageways for cooling air. The teeth of the arm are formed of a ceramic material. They have an upper fixing portion with a pair of inwardly facing hook-like interlocking elements, which are dimensioned to fit loosely over lower horizontal flanges laterally protruding from the underside of the metallic core. In order to provide an insulating and shock absorbing tight connection between the rabble teeth and the metallic core, a fibrous insulating material is interposed between the hook-like formations and the lower horizontal flanges. To complete the insulation of the metallic core, an inner layer of fibrous insulation is placed over the top part of the metallic core, and an outer solid insulation is finally placed on top of the inner fibrous insulation. Lugs on the metallic core prevent the cover from moving longitudinally with respect to the metallic core. In an alternative embodiment, a plurality of wire-like prongs is welded to the metallic core along its sides and top. Thereafter, a layer of fibrous insulating material is pressed down over the prongs so that it lies snugly over the top of the core. A castable insulation is finally cast over the exterior of the rabble arm, where it is held in place by the wire-like prongs.

A first drawback of known rabble arms is a rather high frequency of teeth breaks in the region of their dovetail or hook-like fixing portion. It will be noted in this context that a break-off of a single tooth may cause severe damages to the rabble arms of the hearth chamber, because the broken off rabble portion is an obstacle for the remaining rabble teeth and may cause a break-off of further teeth or even a collapse of whole rabble arms.

A further drawback of known rabble arms is their insufficient protection against high temperatures. The thermal insulation of known rabble arms is indeed deficient in respect of many aspects. It will be noted e.g. that the underside of the rabble arm, which is exposed to the highest heat load, has the poorest insulation. Furthermore, it happens quite often that the thermal insulation of a rabble arm falls off already after a short operation period of the furnace. As an overhauling of the thermal insulation of a rabble arm requires the removal of the rabble arm, the operator of the furnace usually runs usually the risk not to repair the thermal insulation of the rabble arms until the next major overhauling of the furnace, which requires anyway the dismounting of the rabble arms. In the meantime, the unprotected metallic core of the rabble arm is however exposed to a much higher thermal load than the thermal load it is designed to withstand.

Still another drawback of present rabble arms is a poor wear resistance of their rabble teeth. Indeed, most rabble arms are still equipped with cast iron rabble teeth, which become subject to rapid wear under corrosive hearth atmospheres and/or high hearth temperatures. Ceramic rabble teeth would of course be more wear resistant in such atmospheres, but the manufacture of ceramic form pieces of the size of a rabble tooth is still a rather expensive operation. It follows that the use ceramic rabble teeth is normally economically not justified. Furthermore, ceramic rabble teeth may be very wear resistant but they have nevertheless a low ductility, i.e. they are often subjected to breakage in particular in the region of their dovetail or hook-like fixing portion.

Further rabble tooth structures are disclosed in following documents:

U.S. Pat. No. 1,468,216 discloses a cooled rabble tooth structure comprising a cylindrical hub as fixing portion and a hollow tooth blade as rabble portion. The hollow tooth is integrally cast with the cylindrical hub. The cylindrical hubs are assembled end to end on the elongated metallic support core of the rabble arm and cooperate therewith to direct a cooling medium into the hollow teeth.

DE 389355 discloses a rabble tooth structure comprising a sleeve with a trapezoidal cross-section as fixing portion and at least one rabble blade that is integral with the sleeve and projects from a side wall of the latter. The rabble tooth structure is made of a acid proof refractory material.

U.S. Pat. No. 1,687,935 discloses a rabble tooth structure comprising a dovetail fixing portion engaging a corresponding groove at the underside of the metallic support core of the rabble arm.

OBJECTS AND SUMMARY OF THE INVENTION

A first technical problem underlying the present invention is to improve in a cost effective way wear and break-off resistance of the rabble teeth in a rabble arm.

Such a rabble arm for a furnace comprises an elongated metallic support core, at least one rabble tooth having a rabble portion and a fixing portion and fixing means co-operating with the fixing portion for fixing the at least one rabble tooth to the elongated metallic support core. In accordance with an important aspect of the present invention the at least one rabble tooth has the form of a plate, wherein the fixing portion does not include a dove tail, hook or sleeve like fixing element, but its fixing portion is simply formed by a portion of the tooth plate including a through hole through which the elongated metallic support core axially passes. A fixing means co-operates with the fixing portion around the through hole for fixing the rabble tooth to the elongated metallic support core. It follows that the fixing portion of the rabble tooth does no longer include recesses that generate stress concentrations that are probably responsible for most break-offs of rabble teeth. Furthermore, the fixing means can co-operate with the whole fixing portion around the through hole for fixing a rabble tooth to the elongated metallic support core. This means that—in comparison with a rabble tooth that is fixed by means of a dove tail, hook or sleeve like fixing element—a better distribution of stresses can be achieved in the fixing portion.

Another advantageous aspect of the new fixing portion is that the shape of the rabble tooth can be very simple. It may for example have the form of a flat plate with an oval through hole. A direct consequence of the simple shape of the rabble tooth is that it can for example be made of a ceramic material at reasonable costs. In conclusion, the present invention allows to have at reasonable costs rabble teeth having a good wear resistance and being far less subjected to break-off than prior art rabble teeth.

The rabble tooth may have a constant thickness over its height. However, the thickness of the rabble tooth may also be varied over its height, so as to achieve a substantially uniform stress distribution in the rabble tooth. It will be appreciated that such rabble tooth of uniform strength has a reduced weight with regard to a rabble tooth with a constant thickness designed to resist to the same forces.

Instead of making the whole rabble tooth of a single material, it is also possible to conceive a rabble tooth having a fixing portion that consists of a first material and a rabble portion that consists of a second material, wherein the first material is preferably more ductile than the second material. In such a composite rabble tooth, the fixing portion has the advantage to have a good resistance against breakage (it deforms plastically instead of breaking), whereas the rabble portion is more wear resistant. It will be noted that the first material can for example be a cast steel and the second material a ceramic material. The rabble tooth may also include a core made of cast steel, which extends over the fixing portion and the rabble portion and is provided with a ceramic jacket in the rabble portion.

In a preferred embodiment of the rabble arm, the fixing means comprises a teeth support sleeve slipped over the elongated metallic support core and engaging the through hole in the fixing portion of the rabble tooth. Such a teeth support sleeve preferably supports several rabble teeth by engaging their through holes. It provides advantageously a form-fit with the elongated metallic support. In particular, the outer cross-section of the teeth support sleeve and the through hole have for example both an oval shape, so that the teeth support sleeve is blocked in rotation on the elongated metallic support core. The teeth support sleeve provides advantageously a form-fit with the through hole of the rabble tooth.

The teeth support sleeve may be thermally insulated, which allows to have a continuous insulation of the elongated metallic support core that is not interrupted by the fixing elements of the rabble teeth. It will be appreciated that such a continuously insulated teeth support sleeve is thermally more efficient and moreover less exposed to a fall-off than any prior art insulation of a rabble arm. Furthermore, an overhauling of the thermal insulation of a rabble arm requires no longer the removal of the rabble arm, the insulated teeth support sleeve can be simply slipped over the elongated metallic support core, thereby replacing the rabble teeth and the thermal insulation in one operation from the outside of the furnace.

A preferred embodiment of such a teeth support sleeve includes an inner metallic sleeve and an outer metallic sleeve, an insulating material between the inner metallic sleeve and the outer metallic sleeve and a shock absorbing cushioning layer on the outer metallic sleeve. The cushioning layer is engaged by the edge of the through hole in the fixing portion of the rabble tooth, whereby this edge is efficiently protected against mechanical damages, and a shock on one rabble tooth is absorbed by the cushioning layer and not transmitted to the rest of the teeth support sleeve and the metallic support core. Furthermore, the cushioning layer helps to further improve the thermal insulation of the rabble arm. It is recommended to make both the outer tube and the inner tube of stainless steel. Such stainless steel tubes form an efficient continuous sheeting of the rabble arm against an excessive exposure to corrosive gases.

A preferred embodiment of the teeth support sleeve further includes armature elements protruding from the outer metallic sleeve through the shock absorbing cushioning layer and a layer of castable refractory on the shock absorbing cushioning layer, wherein the fixing portion of the rabble tooth is embedded in the refractory layer. It will be appreciated that such a teeth support sleeve can easily be conceived as a prefabricated unit to be simply slipped on the elongated metallic support.

A preferred embodiment of the metallic support core comprises two superimposed outer tubes, which are rigidly fixed together. These superimposed outer tubes are advantageously formed of centrifugally cast steel pipes. It will be appreciated that these outer tubes of the metallic support core have a very homogeneous structure that is substantially free from casting cavities and other casting defects, which are unavoidable in a prior art support core obtained by mould casting. In conclusion, the metallic support core is-despite possibly lower manufacturing costs-less exposed to mechanical failures and corrosion than any other metallic support core of prior art rabble arms.

In order to optimize cooling of the rabble arm, each of the outer tubes advantageously includes a coaxial inner tube, which is arranged in the outer tube so as to delimit therein an annular gap for a coolant flow. Thus, it is warranted to obtain an efficient and homogeneous cooling of the outer tubes. The cooling effect may further be improved at reasonable costs, by simply arranging a wire is the aforementioned annular cooling gap, so as to define a spiral flow path for the coolant in the annular cooling gap.

BRIEF DESCRIPTION OF THE DRAWINGS

The present invention will now be described, by way of example, with reference to the accompanying drawings, in which:

FIG. 5: is a cross-section along section line 5—5 in FIG. 1A;

FIG. 6: is a front view of a rabble tooth; and

FIG. 7: is a vertical section through the rabble tooth of FIG. 6.

DETAILED DESCRIPTION OF A THE INVENTION

Figure 1B:
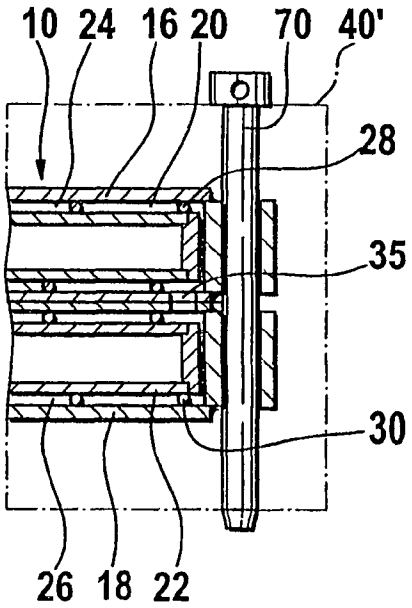
FIG. 1B: is a longitudinal section through the front end of the rabble arm of FIG. 1A.
Figure 1A:
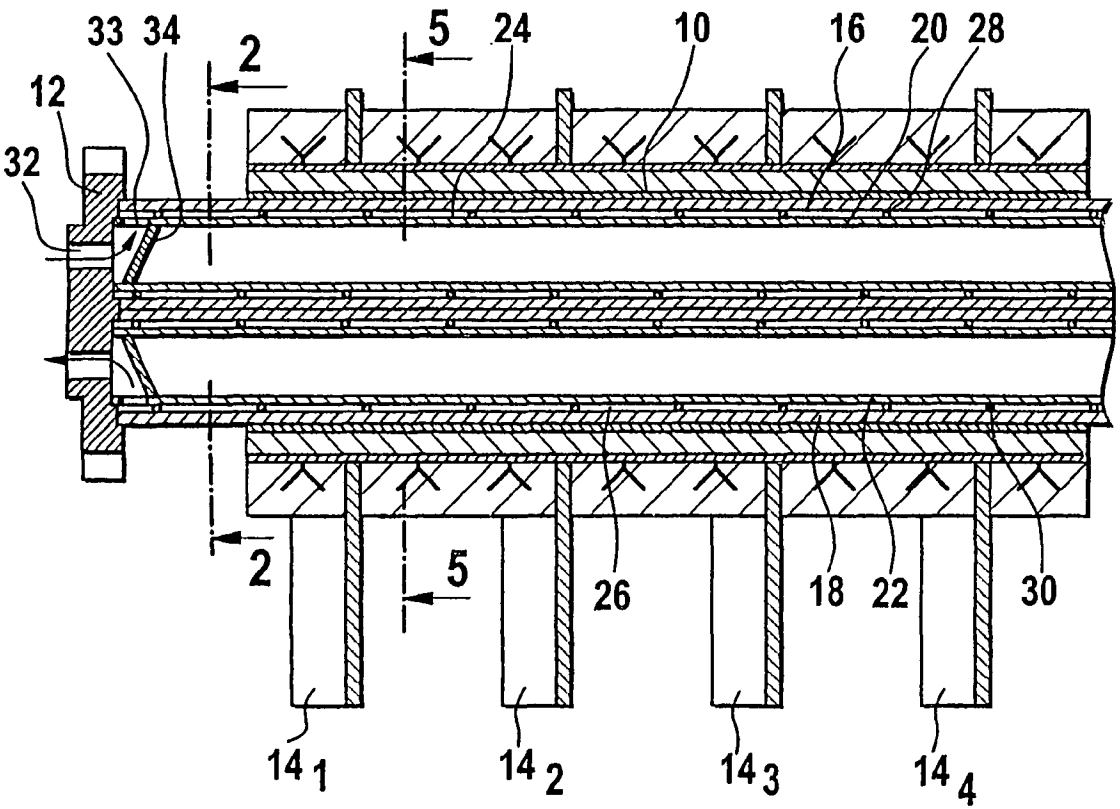
FIG. 1A: is a longitudinal section through the rear end of a rabble arm in accordance with the present invention.

FIGS. 1A and 1B show both end portions of an elongated rabble arm in accordance with the present invention. This rabble arm is to be supported by a vertical shaft in a multiple hearth furnace. It includes an elongated metallic support core 10, i.e. a kind of hollow cantilever beam that is fixed at one end with the help of a fixing flange 12 to the vertical shaft, so as to extend radially outside therefrom over a hearth floor to the furnace wall. The object of this metallic support core 10 is to support radially spaced rabble teeth $\mathbf{14}_1$, $\mathbf{14}_2$, $\mathbf{14}_3$, $\mathbf{14}_4$, which extend down into the material on the hearth floor. As the vertical shaft in the hearth furnace rotates, the rabble arm moves over the material on the respective hearth floor, wherein the rabble teeth $\mathbf{14}_1$, $\mathbf{14}_2$, $\mathbf{14}_3$, $\mathbf{14}_4$ plough through the material on the hearth floor. Depending upon the angle of inclination of the rabble teeth $\mathbf{14}_i$ with respect to the longitudinal axis of the rabble arm (see FIG. 4), the material will be moved radially inwardly toward the vertical shaft or radially outwardly therefrom.

Figure 2:
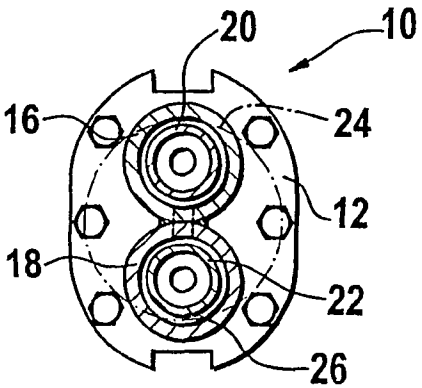
FIG. 2: is a cross-section along section line 2—2 in FIG. 1A.

The metallic support core 10 comprises two superimposed outer tubes 16, 18, which are welded together (see in particular FIG. 2) and welded at one end to the fixing flange 12 (see in particular FIG. 1A). Each of these tubes 16, 18 is preferably made up of one or more centrifugally cast steel pipes. It will be appreciated that the centrifugally cast steel pipes have a very homogeneous structure that is substantially free from casting cavities and other casting defects, which are unavoidable in a prior art support core obtained by mould casting. In conclusion, the metallic support core 10 is—despite possibly lower manufacturing costs—less exposed to mechanical failures and corrosion than any other metallic support core of prior art rabble arms.

Each of the outer tubes 16, 18 includes a coaxial inner tube 20, 22, which is arranged in its outer tube 16, 18 so as to delimit therein an annular gap 24, 26 for a coolant flow. A wire 28, 30 is arranged in each of the annular gaps 24, 26 so as to define a spiral flow path for the coolant. Through an inlet opening 32 in the flange 12 and an inlet chamber 33 with a deflector plate 34, the coolant enters into the annular gap 24 of the upper tube 16 (see FIG. 1A), wherein it is channeled in a spiral path along the inner wall of this tube 16 to the closed front end of the latter (see FIG. 1B). Here the coolant passes through a communication opening 35 into the annular gap 26 of the lower tube 18, wherein it is channeled in a spiral path along the inner wall of this tube 18 to an outlet chamber 37 with a deflector plate 38 (see FIG. 1A), which deflects the coolant into an outlet opening 39 in the flange 12. It remains to be noted that in most cases the coolant will be water, but in specific cases it could be of interest to use a different cooling fluid than water.

Figure 3:
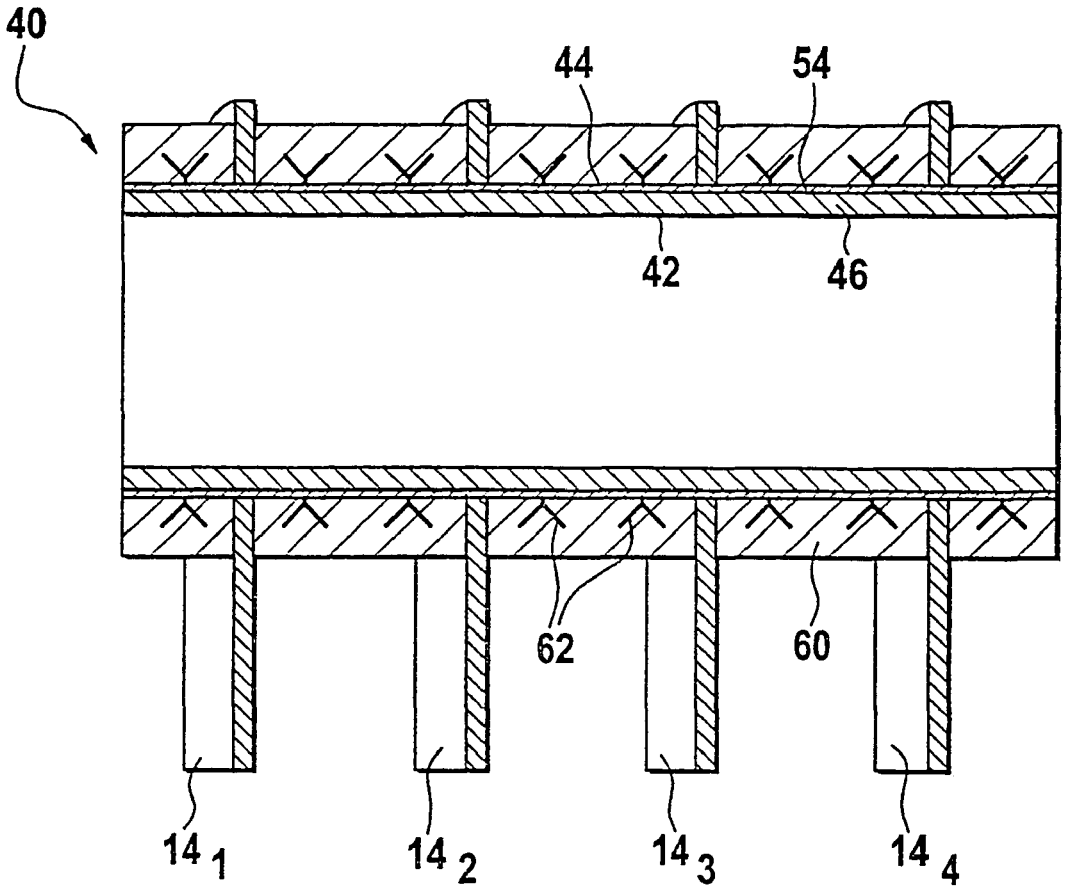
FIG. 3: is a longitudinal section through a teeth support sleeve of the rabble arm of FIG. 1.
Figure 4:
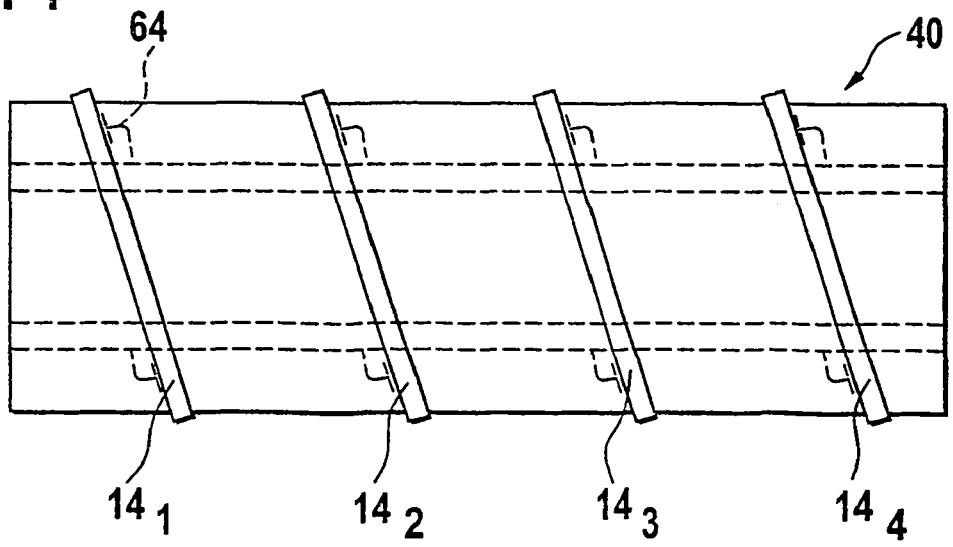
FIG. 4: is a top view of the teeth support sleeve of FIG. 3.

FIGS. 3 and 4 show a teeth support sleeve 40 supporting four rabble teeth $\mathbf{14}_1$, $\mathbf{14}_2$, $\mathbf{14}_3$ and $\mathbf{14}_4$. This teeth support sleeve 40 constitutes with its four rabble teeth $\mathbf{14}_1$, $\mathbf{14}_2$, $\mathbf{14}_3$ and $\mathbf{14}_4$ a prefabricated unit that is axially slipped on the elongated metallic support core 10. In FIG. 1A and FIG. 5, the teeth support sleeve 40 is shown in engagement with the elongated metallic support core 10. It will be noted that such a teeth support sleeve 40 may have substantially the same length as the elongated metallic support core 10, so that only one teeth support sleeve 40 is to be slipped over the elongated metallic support core 10. However, for ease of handling, the teeth support sleeve 40 will usually be substantially shorter than the elongated metallic support core 10, so that several teeth support sleeves 40 have to be slipped one after the other on the elongated metallic support core 10. It is to be understood that a teeth support sleeve 40 may of course support more than four rabble teeth 14 or less than four rabble teeth 14, and that it is also possible to conceive a "teeth" support sleeve with a single rabble tooth 14.

A preferred embodiment of the teeth support sleeve 40 includes an inner metallic sleeve 42 and an outer metallic sleeve 44, which are both preferably made of stainless steel. As shown on FIG. 5, the inner metallic sleeve 42 has an oval cross-section that provides a form-fit with the elongated metallic support core 10. An insulating material 46, preferably a micro-porous insulating material, is arranged between the inner steel tube 42 and the outer metallic sleeve 44 to provide a good thermal insulation.

A preferred embodiment of a rabble tooth 14 will now be described with reference to FIGS. 6 and 7. This rabble tooth 14 consists of a flat elongated ceramic plate, whose first end forms a rabble portion 46, and whose second end forms a fixing portion 48. The fixing portion includes an ovally shaped through hole through 50 bounded by a rounded off or chamfered edge 52. This through hole 50 is more particularly shaped in such a way that its edge 52 makes up a form-fit with the outer surface of the teeth support sleeve, when the rabble tooth 14 is in it is operational position on the teeth support sleeve 40. It will be noted that this outer surface of the teeth support sleeve 40 is advantageously formed by a thinner shock absorbing cushioning layer 54 that envelops the outer metallic sleeve 44. In summary, the elongated metallic support core 10 passes axially through the through hole 50 in the fixing portion 48, and the teeth support sleeve 40 co-operates with the fixing portion around the through hole 50 for fixing the rabble tooth 14 to the elongated metallic support core 10.

Because the rabble tooth 14 has the shape of a simple plate with a through hole in it, it can be manufactured at reasonable costs in a ceramic material that has a good temperature and corrosion resistance and an excellent wear resistance. Alternatively, only the rabble portion 46 may be made of ceramic material, wherein the fixing portion 48 is made of a cast steel. Such a composite rabble tooth has the advantage that a cast steel is generally more ductile than a ceramic material and will thus, under an excessive load, more likely plastically deform itself than break. It will be noted that a deformed rabble tooth may be ineffective, but it does at least not fall on the hearth floor, where it would present a risk for other teeth. In order to warrant a good connection between the rabble portion 46 and the fixing portion 48 in a composite rabble tooth, the latter may include a core made of cast steel. This core extends over the rabble portion 46 and the fixing portion 48 and is provided with a ceramic jacket 55 in the rabble portion. It is of course also possible to make the rabble tooth 14 of any other material that has the required temperature, corrosion and wear resistant properties.

Referring again to FIGS. 3 and 4, it will be noted that the fixing portion 48 of the four rabble teeth $\mathbf{14}_1$, $\mathbf{14}_2$, $\mathbf{14}_3$ and $\mathbf{14}_4$ is embedded in a layer of castable refractory 60, which is cast around the shock absorbing cushioning layer 54. Wire-like armature elements 62 are welded to the outer metallic sleeve 44, before the refractory 60 is cast around the shock absorbing cushioning layer 54. They protrude through the shock absorbing cushioning layer 54 to firmly anchor the refractory 60 to the teeth support sleeve 40. In this way, the rabble teeth $\mathbf{14}_1$, $\mathbf{14}_2$, $\mathbf{14}_3$ and $\mathbf{14}_4$ can be firmly blocked in their operating position on the teeth support sleeve 40, wherein the forces acting on the rabble portion are transmitted via the fixing portion 48 around the through hole 50 as compressive forces onto the refractory 60 and via the edge 52 of the through hole 50 and the shock absorbing cushioning layer 54 to the teeth support sleeve 40. Additionally, metallic shouldering elements 64 (see e.g. FIG. 4) may be welded to the to the outer metallic sleeve 44, before the refractory 60 is cast around the shock absorbing cushioning layer 54. In this case the fixing portion 48 around the through hole 50 bears on these shouldering elements 64, so that the latter contribute to the transmission of forces from the rabble teeth 14 to the outer metallic sleeve 44. It will further be noted that metallic shouldering elements 64 also warrant that the rabble teeth are maintained in their operating position even if the refractory 60 is damaged or falls off.

Teeth support sleeves 40 as shown in FIGS. 3 and 4 can be manufactured in a workshop ready for being slipped onto the metallic support core 10. As shown on FIG. 1B, the end of the last teeth support sleeve 40' (schematically indicated with a doted line) slipped onto the metallic support core 10 is secured to the latter by means of a pin 70. If the teeth $\mathbf{14}_1$, $\mathbf{14}_2$, $\mathbf{14}_3$ and $\mathbf{14}_4$ or the refractory 60 are worn out or damaged, then the teeth support sleeves 40 can be easily slipped off from the metallic support core 10 and replaced by new ones. Worn or damaged teeth support sleeves 40 can be returned to a workshop for being refurbished under optimum conditions. It will be appreciated that the exchange of teeth support sleeves 40 can be easily effected from the outside of the furnace through a maintenance door in the furnace wall, without having to dismount the metallic support core 10 or to enter the furnace. On FIG. 5, reference numbers 72' and 72" refer to withdrawing rods arranged in a free space subsisting between the metallic support core 10 teeth support sleeves 40. These two withdrawing rods 72' and 72" have one end engaged with the first teeth support sleeve 40 slipped onto the metallic support core 10 and the other end protruding out of the last teeth support sleeve 40' slipped onto the metallic support core 10. They allow to easily slip off the teeth support sleeves 40 from the metallic support core 10.

What is claimed is:

1. A rabble arm for a furnace, said rabble arm comprising:

an elongated metallic support core;

at least one rabble tooth having the form of a plate with a rabble portion and a fixing portion, wherein said fixing portion is formed by a portion of said plate including a through hole through which said elongated metallic support core axially passes; and fixing means co-operating with said fixing portion around said through hole for fixing said rabble tooth to said elongated metallic support core, said fixing means including an insulated teeth support sleeve slipped over said elongated metallic support core and engaging said through hole in said fixing portion of said rabble tooth.

2. The rabble arm according to claim 1, wherein said through hole is ovally shaped.

3. The rabble arm according to claim 1, wherein said rabble tooth is made of a ceramic material.

4. The rabble arm according to claim 1, wherein said fixing portion consists of a first material, and said rabble portion consists of a second material, wherein said first material is more ductile than said second material.

5. The rabble arm according to claim 4, wherein said first material is a cast steel and said second material is a ceramic material.

6. The rabble arm according to claim 1, wherein said rabble tooth includes a core made of cast steel, said core extending over said fixing portion and said rabble portion and being provided with a ceramic jacket in said rabble portion.

7. The rabble arm according to claim 1, wherein said teeth support sleeve supports several rabble teeth by engaging their through holes.

8. The rabble arm according to claim 1, wherein said teeth support sleeve provides a form-fit with said elongated metallic support core.

9. The rabble arm according to claim 1, wherein said teeth support sleeve provides a form-fit with said through hole of said at least one rabble tooth.

10. The rabble arm according to claim 1, wherein the outer cross-section of said teeth support sleeve and said through hole are both ovally shaped.

11. The rabble arm according to claim 1, wherein said teeth support sleeve includes:

an inner metallic sleeve and an outer metallic sleeve;

an insulating material between said inner metallic sleeve and said outer metallic sleeve; and a shock absorbing cushioning layer on said outer metallic sleeve, said cushioning layer being engaged by the edge of said through hole in the fixing portion of said rabble tooth.

12. The rabble arm according to claim 11, wherein said inner metallic sleeve and said outer metallic sleeve are both made of stainless steel.

13. The rabble arm according to claim 11, wherein said teeth support sleeve further includes:

armature elements protruding from said outer metallic sleeve through said shock absorbing cushioning layer; and a layer of castable refractory on said shock absorbing cushioning layer, wherein said fixing portion of said at least one rabble tooth is embedded in said refractory layer.

14. The rabble arm according to claim 13, wherein said teeth support sleeve forms a prefabricated unit, which includes said at least one rabble tooth and said layer of castable refractory, and said prefabricated unit is designed to be slipped on said elongated metallic support core.

15. The rabble arm according to claim 6, wherein said teeth support sleeve includes metallic shouldering elements, and said fixing portion bears on said shouldering elements.

16. The rabble arm according to claim 1, wherein said metallic support core comprises two superimposed outer tubes, which are rigidly fixed together.

17. The rabble arm according to claim 16, wherein said superimposed outer tubes are made of centrifugally cast steel pipes.

18. The rabble arm according to claim 17, wherein each of said outer tubes includes a coaxial inner tube, which is arranged in said outer tube so as to delimit therein an annular gap for a coolant flow.

19. The rabble arm according to claim 18, comprising a wire that is arranged is said annular gap so as to define a spiral flow path for the cool-ant in said annular cooling gap.

20. A rabble arm for a furnace, said rabble arm comprising:

an elongated metallic support core;

at least one rabble tooth consisting of a ceramic plate with a rabble portion and a fixing portion including a through hole through which said elongated metallic support core axially passes; and fixing means including an insulated teeth support sleeve slipped over said elongated metallic support core and co-operating with said fixing portion around said through hole for fixing said rabble tooth to said elongated metallic support core.

21. A rabble arm for a furnace, said rabble arm comprising:

an elongated metallic support core;

a plurality of rabble teeth, each of said rabble teeth having a rabble portion and a fixing portion;

fixing means including a teeth support sleeve slipped over said elongated metallic support core and co-operating with said fixing portions for fixing said rabble teeth to said elongated metallic support core, said teeth support sleeve including:

an inner metallic sleeve, an outer metallic sleeve; and an insulating material arranged between said inner metallic sleeve and said outer metallic sleeve, so as to achieve a continuous insulation of the elongated metallic support core.

22. The rabble arm as claimed in claim 21, wherein said inner metallic sleeve provides a form-fit with said elongated metallic support core.

23. The rabble arm as claimed in claim 21, wherein said insulating material is a micro-porous insulating material.

24. The rabble arm as claimed in claim 21, wherein said teeth support sleeve forms with said rabble teeth a prefabricated unit that is slipped over said elongated metallic support.

* * * * *